US011299184B2

(12) United States Patent
Nishimura et al.

(10) Patent No.: US 11,299,184 B2
(45) Date of Patent: Apr. 12, 2022

(54) RAILCAR BOGIE INCLUDING PROTECTIVE FILM AND PROTECTIVE FILM-EQUIPPED PLATE SPRING

(71) Applicant: KAWASAKI JUKOGYO KABUSHIKI KAISHA, Kobe (JP)

(72) Inventors: Takehiro Nishimura, Kobe (JP); Yousuke Tsumura, Kobe (JP); Fumihide Inamura, Kakogawa (JP); Katsuyuki Kawashima, Akashi (JP); Ikko Hanaki, Toyohashi (JP); Yuhei Tanaka, Toyohashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 402 days.

(21) Appl. No.: 16/610,298

(22) PCT Filed: May 1, 2017

(86) PCT No.: PCT/JP2017/017152
§ 371 (c)(1),
(2) Date: Nov. 1, 2019

(87) PCT Pub. No.: WO2018/203367
PCT Pub. Date: Nov. 8, 2018

(65) Prior Publication Data

US 2020/0079402 A1 Mar. 12, 2020

(51) Int. Cl.
*B61F 5/04* (2006.01)
*B61F 3/02* (2006.01)

(52) U.S. Cl.
CPC . *B61F 5/04* (2013.01); *B61F 3/02* (2013.01)

(58) Field of Classification Search
CPC ..... B61F 5/04; B61F 3/02
See application file for complete search history.

(56) References Cited

U.S. PATENT DOCUMENTS

| | | | | |
|---|---|---|---|---|
| 2015/0000553 | A1* | 1/2015 | Kimura | B61F 5/30 105/197.05 |
| 2016/0200328 | A1* | 7/2016 | Nishimura | B61F 5/302 29/896.91 |
| 2016/0251023 | A1* | 9/2016 | Nishimura | B61F 3/02 105/198.6 |
| 2020/0079402 | A1* | 3/2020 | Nishimura | B61F 5/301 |

FOREIGN PATENT DOCUMENTS

| | | | |
|---|---|---|---|
| CN | 103796899 | A | 5/2014 |
| CN | 105593560 | A | 5/2016 |
| CN | 205556536 | U | 9/2016 |
| JP | H06-166153 | A | 6/1994 |
| JP | 2004-051736 | A | 2/2004 |
| JP | 2012-086438 | A | 5/2012 |

(Continued)

*Primary Examiner* — Jason C Smith
(74) *Attorney, Agent, or Firm* — Oliff PLC

(57) ABSTRACT

A railcar bogie includes: a protection target member of the railcar bogie; and a protective film including an adhesive surface stuck to the protection target member. The protective film is configured such that an impact absorbing layer and a flame-retardant layer are laminated in this order from the protection target member side. The impact absorbing layer is thicker than the flame-retardant layer.

8 Claims, 2 Drawing Sheets

(56) References Cited

FOREIGN PATENT DOCUMENTS

| | | | | | |
|---|---|---|---|---|---|
| JP | 2015-003559 | A | | 1/2015 | |
| KR | 20150000553 | A | * | 1/2015 | ..... G09F 9/30 |
| KR | 20150000553 | U | * | 2/2015 | |
| WO | WO-2013038673 | A1 | * | 3/2013 | ..... B61F 5/523 |
| WO | WO-2014203450 | A1 | * | 12/2014 | ..... B61F 5/52 |
| WO | WO-2015052912 | A1 | * | 4/2015 | ..... F16F 1/368 |
| WO | WO-2018203367 | A1 | * | 11/2018 | ..... B61F 5/305 |

* cited by examiner

RAILCAR BOGIE INCLUDING PROTECTIVE FILM AND PROTECTIVE FILM-EQUIPPED PLATE SPRING

TECHNICAL FIELD

The present invention relates to a railcar bogie including a protective film and a protective film-equipped plate spring for a railcar bogie.

BACKGROUND ART

Conventionally, in order to reduce the weight of a railcar, bogies made of fiber-reinforced resin have been developed. A bogie of PTL 1 includes: a plate spring made of fiber-reinforced resin; and a plate spring cover covering the plate spring from above. According to this, the plate spring cover prevents flying stones and the like from colliding with the plate spring, and therefore, the fiber-reinforced resin is prevented from being damaged.

CITATION LIST

Patent Literature

PTL 1: Japanese Laid-Open Patent Application Publication No. 2015-3559

SUMMARY OF INVENTION

Technical Problem

However, the plate spring cover of PTL 1 cannot protect a lower surface of the plate spring, and the degree of freedom of the selection of a protected region is low. Further, the plate spring cover is large, and a rotary mechanism configured to move the plate spring cover such that the plate spring cover follows the deformation of the plate spring is required. This leads to an increase in weight of the railcar.

On the other hand, when the plate spring is protected by coating the surface of the plate spring with paint, the degree of freedom of the setting of the protected region increases, and the increase in weight can be suppressed. However, in order to inspect deterioration and the like of the plate spring at the time of maintenance, the surface of the plate spring is desired to be able to be easily exposed. Further, materials used for the railcar are required to have fire resistance performance. It should be noted that the above-described matters are applied to not only the plate spring but also the other members constituting the railcar.

An object of the present invention is to provide a configuration in which while improving the degree of freedom of the selection of a protected region of a railcar bogie and reducing the weight of a railcar, the surface of a protection target member can be easily exposed, and the railcar bogie has fire resistance performance.

Solution to Problem

A railcar bogie including a protective film according to one aspect of the present invention includes: a protection target member; and a protective film including an adhesive surface stuck to the protection target member. The protective film is configured such that an impact absorbing layer and a flame-retardant layer are laminated in this order from the protection target member side. The impact absorbing layer is thicker than the flame-retardant layer.

According to the above configuration, the protective film is just stuck to the protection target member of the railcar bogie. Therefore, the improvement of the degree of freedom of the selection of the protected region of the railcar bogie and the reduction in the weight of the railcar can be realized. In addition, the protection target member of the railcar bogie that is traveling can be satisfactorily protected from collision with ballasts, snow lumps, or other flying objects by the thick impact absorbing layer. Further, by tearing off the protective film from the protection target member, the surface of the protection target member can be easily exposed. Therefore, the inspection of the protection target member at the time of maintenance can be easily performed. Further, the protective film which satisfies the fire resistance performance required for the railcar can be realized by the flame-retardant layer of the protective film.

Advantageous Effects of Invention

The present invention can provide a configuration in which while improving the degree of freedom of the selection of the protected region of the railcar bogie and reducing the weight of the railcar, the surface of the protection target member can be easily exposed, and the railcar bogie has fire resistance performance.

DESCRIPTION OF EMBODIMENTS

Hereinafter, embodiments will be described with reference to the drawings. In the following description, a direction in which a railcar travels and a carbody extends is defined as a car longitudinal direction, and a lateral direction perpendicular to the car longitudinal direction is defined as a car width direction.

Embodiment 1

Figure 1:
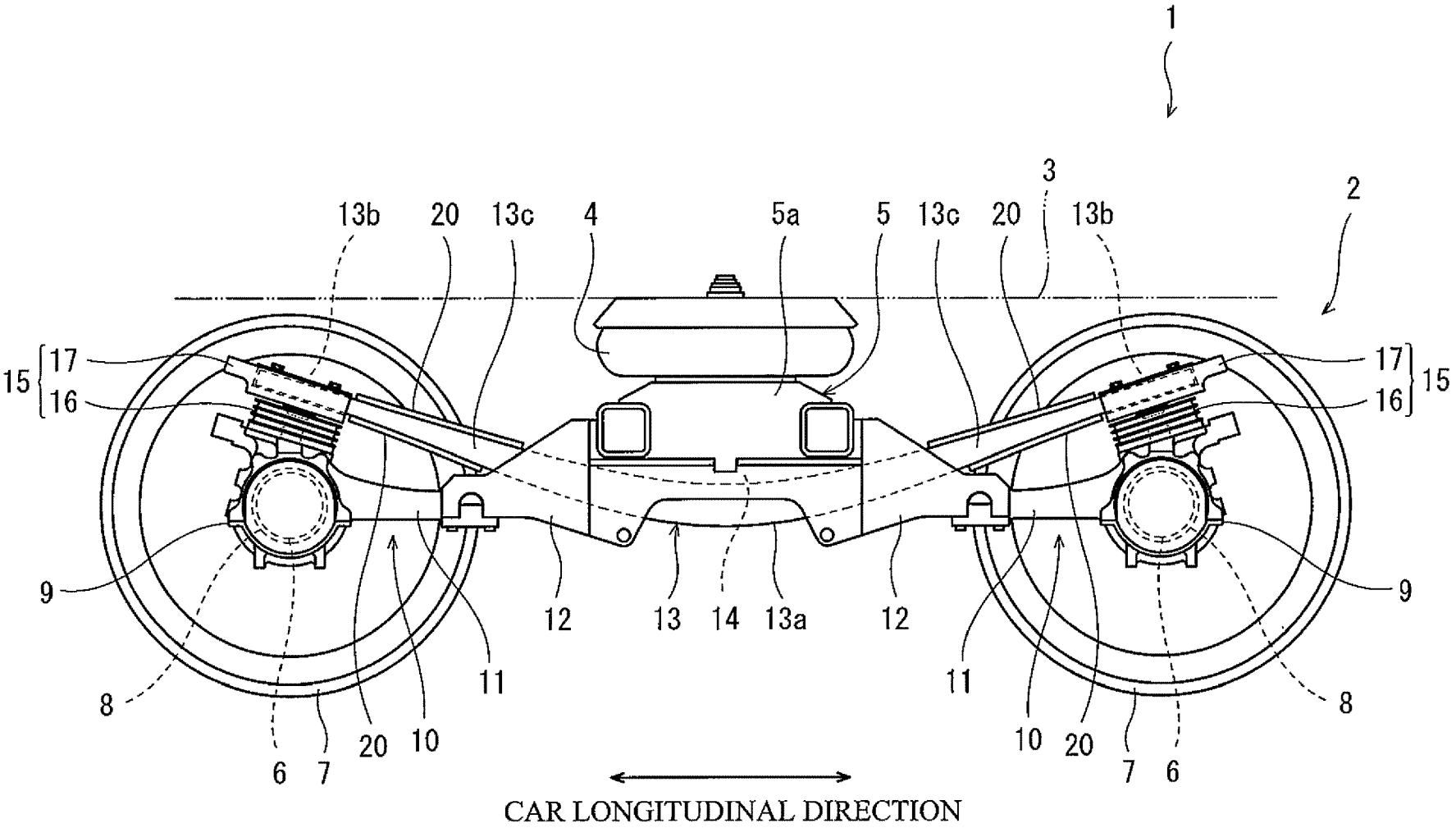
FIG. 1 is a side view of a railcar including a protective film according to Embodiment 1.

FIG. 1 is a side view of a railcar 1 including protective films 20 according to Embodiment 1. As shown in FIG. 1, the railcar 1 includes a bogie 2 and a carbody 3 supporting the bogie 2 from below. The bogie 2 includes a bogie frame 5 supporting the carbody 3 through an air spring 4 as a secondary suspension. The bogie frame 5 includes a cross beam 5*a* extending in the car width direction. However, the bogie frame 5 does not include side sills extending from both respective car width direction end portions of the cross beam 5*a* in the car longitudinal direction. A pair of axles 6 each extending in the car width direction are arranged at both respective sides of the cross beam 5*a* in the car longitudinal direction. Wheels 7 are provided at both respective car width direction end portions of the axles 6. Bearings 8 are provided at both respective car width direction end portions of the axles 6. The bearings 8 are provided outside the corresponding wheels 7 in the car width direction and rotatably support the axles 6. The bearings 8 are accommodated in respective axle boxes 9.

The car width direction end portions of the cross beam 5*a* are coupled to the axle boxes 9 by axle beam type axle box suspensions 10. Each of the axle box suspensions 10 includes an axle beam 11 extending from the axle box 9 in the car longitudinal direction toward the cross beam 5*a*. The bogie frame 5 includes a pair of receiving seats 12 projecting from the cross beam 5*a* toward the axle beam 11 and spaced apart from each other in the car width direction. A tip end portion of the axle beam 11 is elastically coupled to the receiving seats 12 through a rubber bushing (not shown). A pair of axle boxes 9 provided away from each other in the car longitudinal direction support both respective longitudinal direction end portions 13*b* of each of plate springs 13 extending in the car longitudinal direction. Longitudinal direction middle portions 13*a* of the plate springs 13 support the respective car width direction end portions of the cross beam 5*a* from below. With this, the cross beam 5*a* is supported by the axle boxes 9 through the plate springs 13. To be specific, the plate spring 13 has both the function of a primary suspension and the function of a conventional side sill.

The plate spring 13 is made of fiber-reinforced resin. For example, a portion of the plate spring 13 which portion includes at least upper and lower surfaces of the plate spring 13 is made of CFRP. A pressing member 14 having a circular-arc lower surface that is convex downward is provided at a lower portion of each car width direction end portion of the cross beam 5*a*. The pressing member 14 is placed on the middle portion 13*a* of the plate spring 13 from above and separably contacts the middle portion 13*a* of the plate spring 13. To be specific, the pressing member 14 is brought into contact with an upper surface of the plate spring 13 by gravitational downward force from the cross beam 5*a* without fixing the plate spring 13 to the pressing member 14 in an upper-lower direction. To be specific, the pressing member 14 is not fixed to the plate spring 13 by a fixture, but the contact of the pressing member 14 with the upper surface of the plate spring 13 is kept by contact pressure generated by the gravitational downward force from the cross beam 5*a* and reaction force of the plate spring 13 with respect to the gravitational downward force.

A supporting member 15 is attached to an upper end portion of each axle box 9, and the end portion 13*b* of the plate spring 13 is supported by the axle box 9 from below through the supporting member 15. An upper surface of the supporting member 15 is inclined toward a bogie middle side in a side view. The end portion 13*b* of the plate spring 13 is placed on the supporting member 15 from above without being fixed to the supporting member 15 in the upper-lower direction. The supporting member 15 includes a base member 16 (for example, a vibration proof rubber) and a receiving member 17. The base member 16 is provided on the axle box 9. The receiving member 17 is provided and positioned on the base member 16.

The receiving member 17 includes a recess 17*a* in which the end portion 13*b* of the plate spring 13 is accommodated, and the recess 17*a* is open toward an upper side and the bogie middle side. A sheet (for example, a rubber sheet) having lower hardness than the plate spring 13 and the receiving member 17 is sandwiched between a bottom surface of the recess 17*a* of the receiving member 17 and the end portion 13*b* of the plate spring 13. A cover 18 is detachably attached to the receiving member 17 by using fasteners (bolts, for example) so as to cover, from above, the end portion 13*b* of the plate spring 13 accommodated in the recess 17*a*.

The plate spring 13 extends through a space between the pair of receiving seats 12. The middle portion 13*a* of the plate spring 13 is arranged lower than the end portions 13*b*, and the plate spring 13 has a bow shape that is convex downward in a side view. Intermediate portions 13*c* that are intermediate regions each between the middle portion 13*a* and the end portion 13*b* in the plate spring 13 are separated from respective parts of the bogie 2 and arranged in air in a free state. The intermediate portions 13*c* of the plate spring 13 are inclined toward the bogie middle side. The upper and lower surfaces of the end portions 13*b* and intermediate portions 13*c* of the plate spring 13 include inclined regions inclined with respect to a horizontal plane when viewed from the car width direction.

The upper and lower surfaces of the intermediate portions 13*c* of the plate spring 13 are exposed to outside. The protective films 20 are stuck to the respective upper and lower surfaces of the intermediate portions 13*c* of the plate spring 13. It should be noted that the protective films 20 are not stuck to portions of the plate spring 13 which portions are covered with other members (i.e., the protective films 20 are not stuck to, for example, the upper surface of the middle portion 13*a* of the plate spring 13 and the upper and lower surfaces of the end portions 13*b* of the plate spring 13). Further, the protective films 20 are not stuck to side surfaces of the plate spring 13 which surfaces are parallel to the car longitudinal direction. The side surfaces of the plate spring 13 are exposed to outside.

Figure 2:
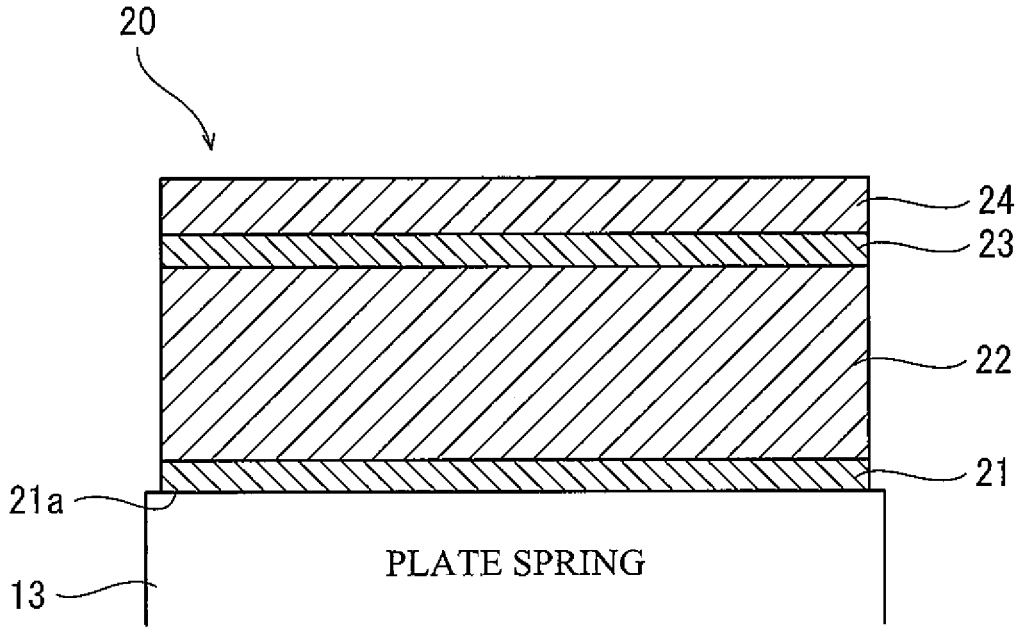
FIG. 2 is an enlarged sectional view of the protective film shown in FIG. 1.

FIG. 2 is an enlarged sectional view of the protective film 20 shown in FIG. 1. As shown in FIG. 2, the protective film 20 includes an adhesive layer 21, an impact absorbing layer 22, a colored layer 23, and a flame-retardant layer 24. The adhesive layer 21, the impact absorbing layer 22, the colored layer 23, and the flame-retardant layer 24 are laminated in this order from the plate spring 13 (protection target member) side. The adhesive layer 21 includes an adhesive surface 21*a* stuck to the plate spring 13. The flame-retardant layer 24 is a surface layer of the protective film 20 and exposed to outside. As above, the protective film 20 has a single sheet shape formed by combining the respective layers.

The adhesive layer 21 includes the adhesive surface 21*a* at an opposite side of the impact absorbing layer 22, and the adhesive surface 21*a* is stuck to the plate spring 13. It is preferable that the adhesive layer 21 be made of such a material that adhesive force of the adhesive surface 21*a* with respect to the plate spring 13 is 5 N/20 mm or more and 35 N/20 mm or less. It is more preferable that the adhesive layer 21 be made of such a material that the adhesive force of the adhesive surface 21*a* with respect to the plate spring 13 is 10 N/20 mm or more and 30 N/20 mm or less. The adhesive force of the adhesive layer 21 is measured based on JIS Z 0237 (2009) in such a manner that the adhesive layer 21 is stuck to an adherend, and after 30 minutes, the adhesive layer 21 is torn off from the painted adherend (SUS304BA steel plate) under conditions of a tension rate of 300 mm/min and a tension angle of 180°. The adhesive layer 21 includes, for example, an acrylic adhesive agent. As one example, the adhesive layer 21 may be constituted by a single adhesive agent layer or an adhesive tape formed by applying an adhesive agent to one or both of surfaces of non-woven fabric or the like. The thickness of the adhesive layer 21 is preferably 10 μm or more and 200 μm or less, more preferably 50 μm or more and 180 μm or less, further preferably 70 μm or more and 160 μm or less. Before the protective film 20 is stuck to the plate spring 13, i.e., while the protective film 20 is being stored, a release liner (for example, a PET sheet; not shown) may be attached to the adhesive surface 21*a* of the adhesive layer 21.

The impact absorbing layer 22 is made of a soft material for mechanically protecting the plate spring 13 from flying objects. For example, according to the soft material, a peak of tanδ in the measurement of dynamic viscoelasticity at a frequency of 1 Hz exists between −50° C. and 50° C. For example, the impact absorbing layer 22 is made of porous resin. The porosity of the porous resin is preferably 0.1 to 50 vol %, and the impact absorbing layer 22 has adhesiveness. The adhesive force of the impact absorbing layer 22 is larger than the adhesive force of the adhesive layer 21. In other words, the adhesive force of the adhesive layer 21 with respect to the plate spring 13 is smaller than the adhesive force of the impact absorbing layer 22 with respect to the adhesive layer 21. As one example, the impact absorbing layer 22 is an acryl foam adhesive agent. The thickness of the impact absorbing layer 22 is preferably 500 μm or more and 4,000 μm or less, more preferably 700 μm or more and 1,000 μm or less.

The colored layer 23 is sandwiched between the impact absorbing layer 22 and the flame-retardant layer 24 and contains a coloring agent (for example, a pigment). As one example, the colored layer 23 is a double-sided adhesive tape formed such that: an adhesive agent is applied to both surfaces of non-woven fabric; and the adhesive agent contains a coloring agent. The adhesive agent of the colored layer 23 is, for example, an acrylic adhesive agent. The thickness of the colored layer 23 is preferably 1 μm or more and 200 μm or less, more preferably 3 μm or more and 160 μm or less. As another example, the colored layer 23 may be a coloring agent applied to the flame-retardant layer 24 by, for example, printing.

The flame-retardant layer 24 has flame retardancy and is thinner than the impact absorbing layer 22. A tensile strength of the flame-retardant layer 24 is higher than tensile strengths of the adhesive layer 21, the impact absorbing layer 22, and the colored layer 23. A thermal expansion coefficient of the flame-retardant layer 24 is lower than thermal expansion coefficients of the adhesive layer 21, the impact absorbing layer 22, and the colored layer 23. For example, the flame-retardant layer 24 is made of: resin selected from polyimide and vinyl chloride; thermoplastic resin containing a flame retardant (such as a phosphorus flame retardant, a halogen flame retardant, or a metal hydroxide flame retardant); a glass fiber sheet; or a metal film (such as aluminum, stainless steel, copper, titanium, or iron). The flame-retardant layer 24 is transparent or semi-transparent. In the present embodiment, the flame-retardant layer 24 is made of polyimide having high weather resistance. The thickness of the flame-retardant layer 24 is preferably 10 μm or more and 400 μm or less, more preferably 30 μm or more and 350 μm or less. The thickness of the flame-retardant layer 24 is preferably 1% or more and 50% or less of the thickness of the impact absorbing layer 22, more preferably 5% or more and 40% or less of the thickness of the impact absorbing layer 22.

According to the above-described configuration, the plate spring 13 of the railcar 1 is protected only by sticking the protective films 20 to the plate spring 13. Thus, the improvement of the degree of freedom of the selection of the protected region of the railcar 1 and the reduction in the weight of the railcar 1 can be realized. Further, since the impact absorbing layer 22 is thicker than the flame-retardant layer 24, the plate spring 13 of the railcar 1 that is traveling can be satisfactorily protected from collision with flying objects by the impact absorbing layer 22. The surface of the plate spring 13 can be easily exposed by removing the protective films 20 from the plate spring 13. Therefore, the inspection (for example, ultrasonic flaw inspection) of the plate spring 13 at the time of maintenance can be easily performed. Further, the protective film that satisfies the fire resistance performance required for the railcar can be realized by the flame-retardant layer 24 of the protective film 20.

The adhesive force of the adhesive layer 21 with respect to the plate spring 13 is smaller than the adhesive force of the impact absorbing layer 22 with respect to the adhesive layer 21. Therefore, when tearing off the protective film 20 from the plate spring 13, the protective film 20 is prevented from partially remaining on the plate spring 13, and the inspection of the plate spring 13 at the time of maintenance can be accurately performed. The adhesive force of the adhesive layer 21 is smaller than the adhesive force of the impact absorbing layer 22. Therefore, when tearing off the protective film 20 from the plate spring 13, the protective film 20 can be stably separated at not a boundary between the adhesive layer 21 and the impact absorbing layer 22 but a boundary between the adhesive layer 21 and the plate spring 13.

The adhesive force of the adhesive surface 21*a* stuck to the plate spring 13 is 35 N/20 mm or less. Therefore, when tearing off the protective film 20 from the plate spring 13, the protective film 20 can be suitably prevented from partially remaining on the plate spring 13. The adhesive force of the adhesive surface 21*a* stuck to the plate spring 13 is 5 N/20 mm or more. Therefore, even when the plate spring 13 bends or vibrates while the railcar 1 is traveling, the protective film 20 can be prevented from deviating or falling.

The flame-retardant layer 24 as the surface layer is transparent or semitransparent. Therefore, the color of the protective film 20 when viewed from outside can be changed by changing the color of the colored layer 23 without changing the flame-retardant layer 24. On this account, the degree of freedom of the selection of the color can be increased without changing the performance of the flame-retardant layer 24.

The tensile strength of the flame-retardant layer 24 is high. Therefore it is possible to prevent a case where when tearing off the protective film 20 from the plate spring 13, the protective film 20 is cut by the tensile force, and the protective film 20 partially remains on the plate spring 13.

The thickness of the flame-retardant layer 24 is 10 μm or more. Therefore, when tearing off the protective film 20 from the plate spring 13, the protective film 20 can be more suitably prevented from being cut by the tensile force. Further, wrinkles on the surface of the protective film 20 can be prevented from being generated by the thickness of the flame-retardant layer 24. Thus, excellent appearance can be secured. The thickness of the flame-retardant layer 24 is 400 μm or less. Therefore, while suppressing the increase in the thickness of the entire protective film 20, the thickness of the impact absorbing layer 22 is adequately secured. Thus, excellent impact resistance can be obtained. The impact absorbing layer 22 is adequately thick. Therefore, even when the plate spring 13 repeats elastic deformation, distortion by the deformation is absorbed by the impact absorbing layer 22. Thus, stress transmission to the flame-retardant layer 24 can be suppressed.

When a material, such as polyimide, which deteriorates little by ultraviolet is selected as a material of the flame-retardant layer 24, discoloration hardly occurs. Thus, excellent appearance can be secured.

The protective films 20 are selectively stuck to portions of the inclined regions of the upper and lower surfaces of the plate spring 13 which portions are exposed to outside. Therefore, while suppressing the amount of protective films 20 used, the damage of the plate spring 13 can be satisfactorily prevented when flying objects collide in a traveling direction with the above exposed portions of the inclined regions of the plate spring 13 of the railcar 1 that is traveling at high speed. The protective film 20 is not stuck to a portion that is not exposed to outside (for example, the upper and lower surfaces of the end portions 13*b* of the plate spring 13) but is stuck to the intermediate portion 13*c* that is exposed to outside. Therefore, even when the bogie 2 is in a non-dismantled state, the protective film 20 can be easily attached to and detached from the plate spring 13.

Embodiment 2

Figure 3:
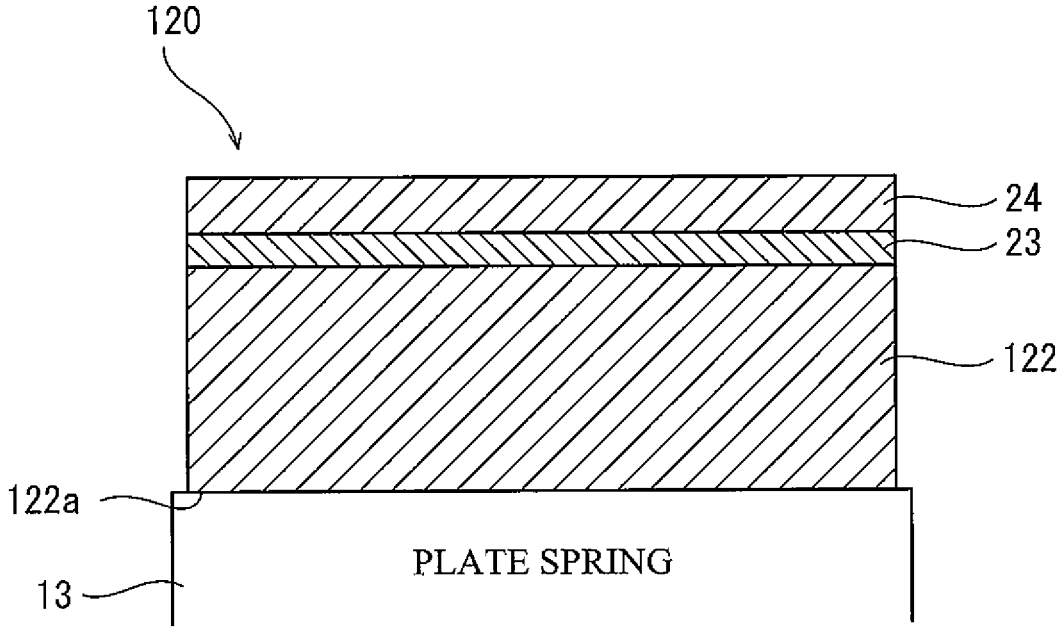
FIG. 3 is an enlarged sectional view of the protective film according to Embodiment 2.

FIG. 3 is an enlarged sectional view of a protective film 120 according to Embodiment 2. As shown in FIG. 3, the protective film 120 of Embodiment 2 is different from the protective film 20 of Embodiment 1 in that the protective film 120 of Embodiment 2 does not include the adhesive layer 21. To be specific, the protective film 120 is formed such that an impact absorbing layer 122, the colored layer 23, and the flame-retardant layer 24 are laminated in this order from the plate spring 13 side. As one example, the impact absorbing layer 122 is an acryl foam adhesive agent. The impact absorbing layer 122 includes an adhesive surface 122*a* at an opposite side of the colored layer 23, and the adhesive surface 122*a* is stuck to the plate spring 13.

It is preferable that the adhesive force of the adhesive surface 122*a* of the impact absorbing layer 122 be 35 N/20 mm or less. With this, when tearing off the protective film 120 from the plate spring 13, the protective film 120 is prevented from partially remaining on the plate spring 13. It is preferable that the adhesive force of the adhesive surface 122*a* of the impact absorbing layer 122 be 5 N/20 mm or more. With this, even when the plate spring 13 bends or vibrates while the railcar 1 is traveling, the protective film 120 can be prevented from deviating or falling. Since the other components in Embodiment 2 are the same as those in Embodiment 1, explanations thereof are omitted.

The present invention is not limited to the above embodiments, and modifications, additions, and eliminations may be made with respect to the configurations of the embodiments. The protection target member of the railcar is not limited to the plate spring. Examples of the protection target member include members to be protected from flying objects and the like, such as the other parts of the bogie, part of a bogie underframe, part of the carbody, and an underfloor closing plate. In this case, it is preferable that the protection target member be made of fiber-reinforced resin. The colored layer does not have to be provided on the protective film.

REFERENCE SIGNS LIST

1 railcar
2 bogie
13 plate spring (protection target member)
13*c* intermediate portion (inclined region)
20, 120 protective film
21 adhesive layer
21*a*, 122*a* adhesive surface
22, 122 impact absorbing layer
23 colored layer
24 flame-retardant layer

The invention claimed is:

1. A railcar bogie comprising:
a protection target member; and
a protective film including an adhesive surface stuck to the protection target member, wherein:
the protective film is configured such that an impact absorbing layer and a flame-retardant layer are laminated in this order from the protection target member side; and
the impact absorbing layer is thicker than the flame-retardant layer.

2. The railcar bogie according to claim 1, wherein:
an adhesive layer including the adhesive surface is laminated on the impact absorbing layer from the protection target member side; and
adhesive force of the adhesive layer with respect to the protection target member is smaller than adhesive force of the impact absorbing layer with respect to the adhesive layer.

3. The railcar bogie according to claim 1, wherein adhesive force of the adhesive surface with respect to the protection target member is 5 N/20 mm or more and 35 N/20 mm or less.

4. The railcar bogie according to claim 1, wherein:
a colored layer is laminated between the flame-retardant layer and the impact absorbing layer; and
the flame-retardant layer is transparent or semitransparent.

5. The railcar bogie according to claim 1, wherein the flame-retardant layer is resin selected from polyimide and vinyl chloride, thermoplastic resin containing a flame retardant, a glass fiber sheet, or a metal film.

6. The railcar bogie according to claim 5, wherein a thickness of the flame-retardant layer is 10 μm or more and 400 μm or less.

7. A protective film-equipped plate spring for a railcar bogie,
the protective film-equipped plate spring comprising:
a plate spring made of fiber-reinforced resin and mounted on the railcar bogie; and
the protective film according to claim 1, the protective film being stuck to the plate spring.

8. The protective film-equipped plate spring according to claim 7, wherein:
upper and lower surfaces of the plate spring include inclined regions inclined with respect to a horizontal plane when viewed from a car width direction; and
the protective film is stuck to each of portions of the inclined regions of the upper and lower surfaces of the plate spring, the portions being exposed to outside.

* * * * *